US009321287B1

(12) United States Patent
Ipponyari et al.

(10) Patent No.: US 9,321,287 B1
(45) Date of Patent: Apr. 26, 2016

(54) PRINTING POSITION AND CUTTING POSITION ADJUSTING METHOD

(71) Applicant: MIMAKI ENGINEERING CO., LTD., Nagano (JP)

(72) Inventors: Tadanori Ipponyari, Nagano (JP); Masashi Doi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/924,730

(22) Filed: Oct. 28, 2015

(30) Foreign Application Priority Data

Oct. 31, 2014 (JP) ..... 2014-223771

(51) Int. Cl.
*B41J 29/393* (2006.01)
*B41J 11/66* (2006.01)
*B41J 2/01* (2006.01)

(52) U.S. Cl.
CPC . *B41J 11/663* (2013.01); *B41J 2/01* (2013.01)

(58) Field of Classification Search
CPC ..... B41J 11/663; B41J 11/0005; B41J 29/42; B41J 11/00; B41J 11/706; B41J 29/3935; B41J 2002/17569; B41J 11/42; B41J 11/0008
See application file for complete search history.

(56) References Cited

U.S. PATENT DOCUMENTS 8,641,305 B2 * 2/2014 Yasuzaki ..... B41J 3/60 347/104
8,752,929 B2 * 6/2014 Arakane ..... B41J 23/04 347/16
8,827,407 B2 * 9/2014 Ogawa ..... B41J 13/0009 347/16

FOREIGN PATENT DOCUMENTS

JP 2006-095822 4/2006

* cited by examiner

*Primary Examiner* — Lamson Nguyen
(74) *Attorney, Agent, or Firm* — Jianq Chyun IP Office

(57) ABSTRACT

A printing position and cutting position adjusting method includes: printing a correction value deriving image on a medium, the correction value deriving image is used to calculate a value of correction of an ink-jet head in a sub scanning direction relative to image data of an image, during the image is printed on the medium by the ink-jet head that discharges an ink on the medium for printing; calculating a ratio, in the sub scanning direction, of the image printed on the medium to the image data based on the correction value deriving image; and printing the image on the medium using the ink-jet head and cutting the medium using a cutting head based on the image data. The cutting head, during cutting the medium based on the image data, cuts the medium at a cutting position in the sub scanning direction corrected based on the value of correction.

4 Claims, 7 Drawing Sheets

PRINTING POSITION AND CUTTING POSITION ADJUSTING METHOD

CROSS REFERENCE TO RELATED APPLICATIONS

This application claims the priority benefit of Japan Application No. 2014-223771, filed on Oct. 31, 2014. The entirety of the above-mentioned patent application is hereby incorporated by reference herein and made a part of this specification.

TECHNICAL FIELD

The disclosure relates to a printing position and cutting position adjusting method.

DESCRIPTION OF THE BACKGROUND ART

Some of conventional ink-jet printers are structured to print an object on a print medium and then cut the medium in accordance with the printed image. An example of such ink-jet printers is an ink-jet printer equipped with a cutting head described in Patent Document 1. This ink-jet printer has a cutting head and an ink-jet head, wherein an image is printed on a medium by the ink-jet head, and the image-printed medium is cut by the cutting head along, for example, the contour of the printed image.

[Patent Document 1] JP 2006-95822 A.

When an image is printed on a medium and the image-printed medium is then cut in accordance with the image printed thereon as described in the prior art document, adjustment is necessary between the position of the image printed by the ink-jet head and the position of cutting by the cutting head. The adjustment of these positions specifically includes printing cross-shaped marks, generally called register marks, at four corners of the printed image, detecting the positions of the printed register marks, and comparing the detected positions of the register marks to the positions of register marks in print data. The position adjustment further includes calculating through comparison the ratio of the actually printed image to the print data, and correcting the position of cutting by the cutting head based on the calculated ratio.

For the position adjustment, it is necessary to print and positionally detect the register marks for each image to be printed and calculate the ratio of the printed image to the print data. The position adjustment thus necessitating a number of processes associated with printing and cutting is a very complicated procedure. Additionally, it is necessary to secure on a print medium enough space for the register marks to be printed.

SUMMARY

Faced with the conventional disadvantages, the disclosure described herein provides a printing position and cutting position adjusting method that may facilitate adjustment of printing and cutting positions.

To overcome the disadvantages, the disclosure provides a printing position and cutting position adjusting method including: printing a correction value deriving image on a medium, the correction value deriving image being used to calculate a value of correction of an ink-jet head in a sub scanning direction relative to image data of an image, during the image is printed on the medium by the ink-jet head that discharges an ink on the medium for printing; calculating a ratio, in the sub scanning direction, of the image printed on the medium to the image data based on the correction value deriving image; and printing the image on the medium using the ink-jet head and cutting the medium using a cutting head based on the image data, wherein the cutting head, during cutting the medium based on the image data, cuts the medium at a cutting position in the sub scanning direction corrected based on the value of correction.

According to the disclosure, the value of correction applied to the image data of the image to be printed on the medium is obtained from the correction value deriving image. Before the medium is cut based on the image data, the cutting position in the sub scanning direction is corrected based on the obtained value of correction. This may facilitate alignment of the cutting position to the printing position. The medium may be cut along the image printed on the medium at the cutting position well-aligned to the printing position by way of the cutting data correction alone without the need to detect the size of the printed image. This may advantageously facilitate adjustment of the printing and cutting positions.

The printing position and cutting position adjusting method preferably obtains the ratio, in the sub scanning direction, of the image printed on the medium to the image data by calculating a ratio between a width of a 1-path image printed by one reciprocation in a main scanning direction of the ink-jet head discharging the ink to print the correction value deriving image and an interval or an overlapping width between the 1-path images adjacently arranged in the sub scanning direction.

According to the disclosure, the ratio of the image printed on the medium to the image data is obtained by calculating a ratio between the width of a 1-path image of the correction value deriving image and an interval or an overlapping width between the 1-path images adjacently arranged in the sub scanning direction. Therefore, the cutting data may be corrected based on the same value of correction as in the correction of the image data. The cutting position may be more accurately aligned to the printing position. This may advantageously ensure high accuracy in adjustment of the printing and cutting positions.

The printing position and cutting position adjusting method preferably calculates a plurality of the values of correction correspondingly to a printing state on the medium, wherein the cutting head cuts the medium at the cutting position in the sub scanning direction corrected based on the plurality of the values of correction.

According to the disclosure, the cutting position at which the medium is cut in the sub scanning direction is corrected based on the plural values of correction. In the event that the rate of feed of the medium changes, the cutting operation may flexibly respond to the changing rate of feed. Therefore, the printing and cutting positions may continue to be accurately adjusted even when the rate of feed of the medium changes.

The printing position and cutting position adjusting method according to the disclosure may advantageously facilitate adjustment of the printing and cutting positions.

DETAILED DESCRIPTION OF EMBODIMENTS

Hereinafter, embodiments of the printing position and cutting position adjusting method according to the disclosure are described in detail referring to the accompanying drawings. It should be understood that implementations disclosed herein are not restricted by the embodiment. The structural elements described in the embodiments may be replaced with other possible options by those skilled in the art, and may include easily obtainable or substantially identical elements.

Embodiment

Figure 1:
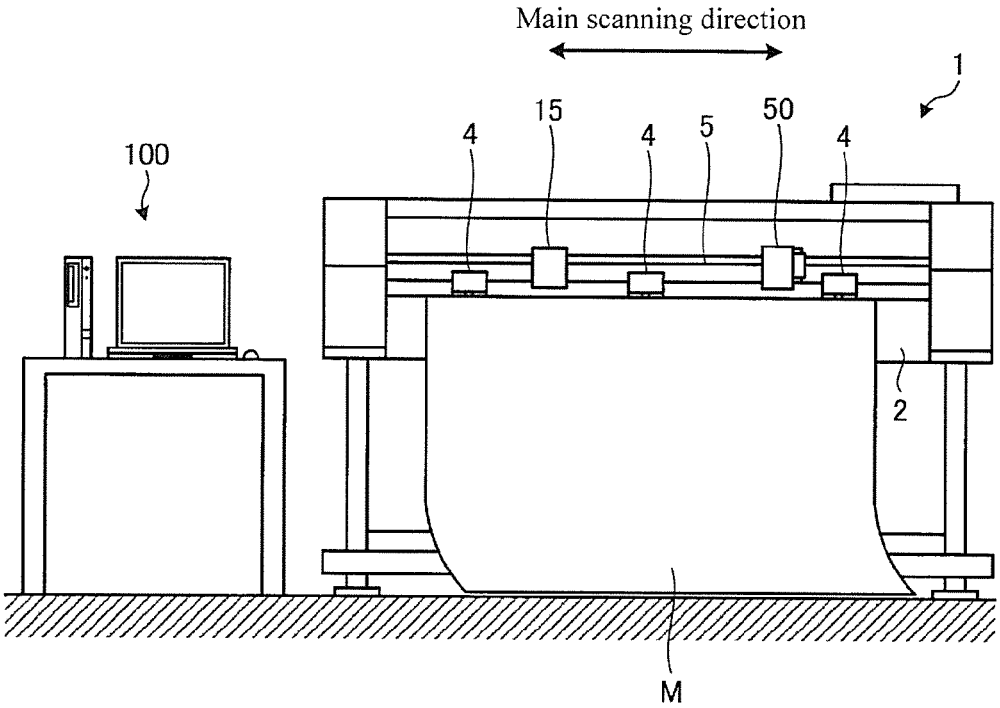
FIG. 1 is a front view of an ink-jet printer equipped with a cutting head that performs printing and cutting using a printing position and cutting position adjusting method according to an embodiment.

FIG. 1 is a front view of an ink-jet printer equipped with a cutting head that performs printing and cutting using a printing position and cutting position adjusting method according to an embodiment. An ink-jet printer 1 with a cutting head (hereinafter, ink-jet printer) illustrated in FIG. 1 has, in addition to its function to perform ink-jet printing on a print medium M, a function to cut the medium M. The ink-jet printer 1 has an ink-jet head 15 that discharges an ink on the medium M to print an object thereon, and a cutting head 50 used to cut the medium M. The ink jet head 15 and the cutting head 50 are disposed at positions facing a print surface of the medium M. The ink-jet head 15 and the cutting head 50 are mounted to a guide rail 5 extending in a main scanning direction and movable along the guide rail 5. The ink-jet head 15 and the cutting head 50 are accordingly movable in the main scanning direction orthogonal to a sub scanning direction which is a feeding direction of the medium M.

Referring to FIG. 1, the ink-jet head 15 and the cutting head 50 are located at positions above the medium M for illustrative purpose. When the ink-jet printer 1 is active, one of the ink-jet head 15 and the cutting head 50 moves away from above the medium M. The ink-jet head 15 and the cutting head 50, whenever neither of them is used, they both move away from above the medium M.

The ink-jet printer 1 thus structurally characterized is connected to a computer 100 such as a personal computer and controllable by the computer 100. In the computer 100 are pre-stored data and programs used to control the ink-jet printer 1. By running the programs, the computer 100 is operable to control the ink-jet printer 1.

Figure 2:
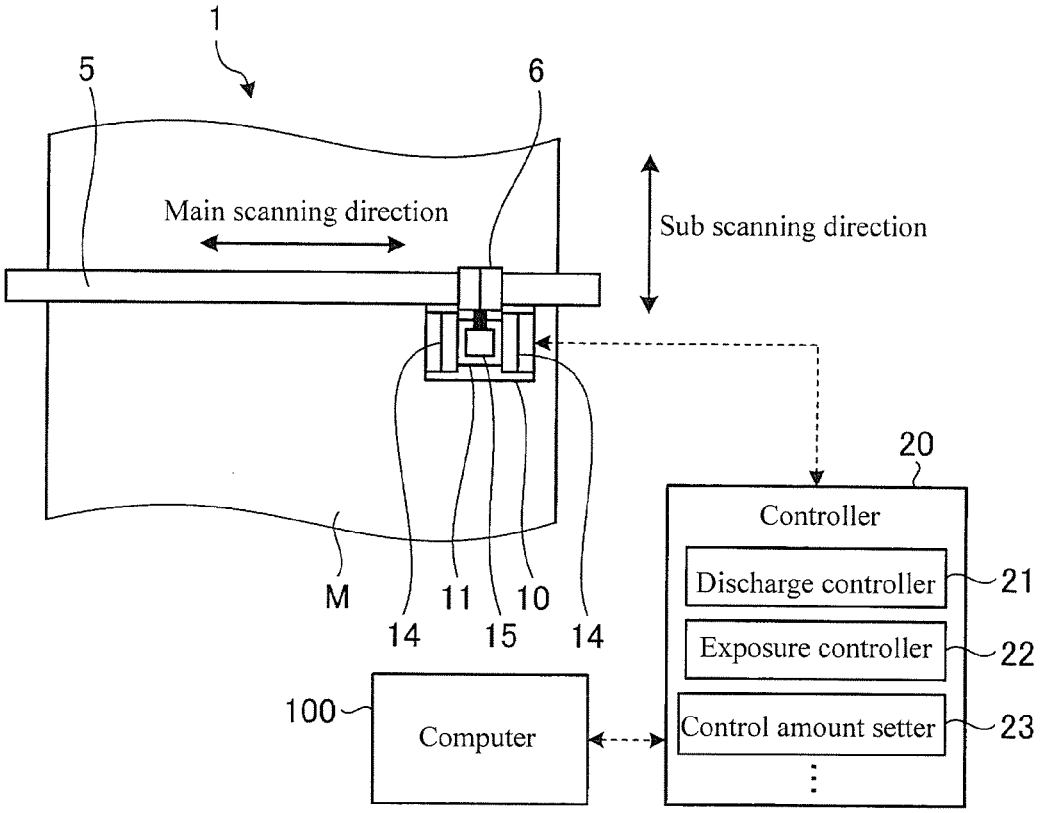
FIG. 2 is a plan view of an ink-jet head of the ink-jet printer illustrated in FIG. 1.

FIG. 2 is a plan view of an ink-jet head of the ink-jet printer illustrated in FIG. 1. The guide rail 5 is mounted with a carriage 10 that is allowed to move in the main scanning direction along the guide rail 5. The carriage 10 has a holder 11 for holding the ink-jet head 15, and a pair of ultraviolet lamps 14 attached to lateral sides of the holder 11 in the main scanning direction. The ink-jet head 15 thus held in the holder 11 and then loaded in the carriage 10 is allowed to move in the main scanning direction. The carriage 10 has an ink tank 6. The ink tank 6 mounted to the carriage 10 stores therein the ink to be discharged on the medium M by the ink-jet head 15. When the carriage 10 moves in the main scanning direction, the ink tank 6 is capable of moving integrally with the carriage 10.

The ink-jet head 15 is structured to discharge the ink stored in the ink tank 6 on the medium M. The ink-jet head 15 includes such structural elements as nozzles 31 facing the medium M to discharge the ink thereon (see FIG. 3), ink flow paths that provide connection between the ink tank 6 and the nozzles 31, and regulators and pumps disposed on the ink flow paths. By driving the pumps, the ink-jet head 15 having the plural nozzles 31 performs ink-jet discharge of the ink from the ink tank 6 toward the medium M through each of the nozzles 31 in a predetermined quantity.

The ultraviolet lamps 14 irradiate ultraviolet for light exposure of the ink discharged on the medium M. The ultraviolet lamps 14, for example, include ultraviolet-emitting LED modules.

A controller 20 is in charge of controlling the structural elements of the ink-jet printer 1. The controller 20 includes, in terms of functional concepts, for example, a discharge controller 21, an exposure controller 22, and a control amount setter 23. The controller 20 further includes hardware devices such as a computing device and a memory, and programs that effectuate predetermined functions of these devices. The computer 100 connected to the ink-jet printer 1 is further connected to the controller 20. The controller 20 is capable of transmitting and receiving information to and from the computer 100.

The discharge controller 21 of the controller 20 controls the pumps of the ink-jet head 15, thereby controlling the quantity, timing, and duration of the ink discharge from the ink-jet head 15. The exposure controller 22 controls the ultraviolet lamps 14, thereby regulating the intensities of ultraviolet irradiated from the ultraviolet lamps 14, and timings and durations of light exposure. The control amount setter 23 generates print patterns based on information inputted from the computer 100 connected to the controller 20 to set controlled variables of the ink discharge and light exposure.

Figure 3:
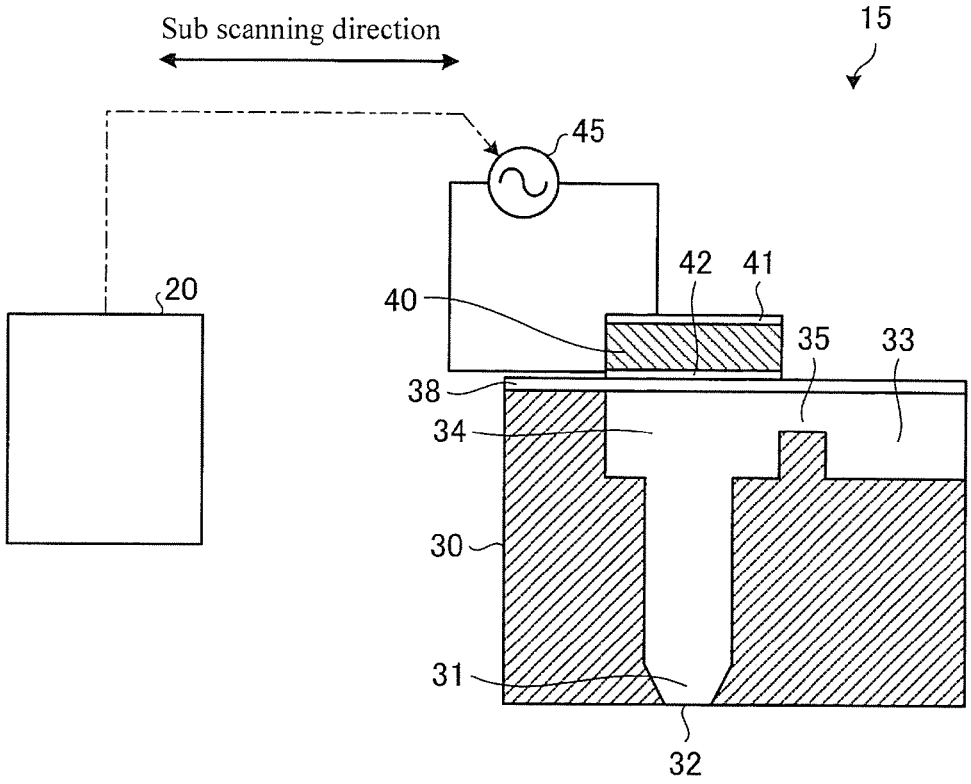
FIG. 3 is a detailed view of the ink-jet head illustrated in FIG. 2.

FIG. 3 is a detailed view of the ink-jet head illustrated in FIG. 2. The ink-jet head 15 has a body 30, nozzles 31, an inlet 33, an ink chamber 34, a diaphragm 38 as a vibratory member, and piezoelectric elements 40. The nozzles 31 extend along the vertical direction of the body 30 when the ink-jet head 15 is held by the carriage 10. The nozzles 31 each have a discharge port 32 at its lower end. The ink is discharged through the discharge port 32.

The inlet 33 is connected to the nozzles 31 by way of a groove 35 formed in the body 30. The ink chamber 34 is formed in communication with the nozzles 31 and the inlet 33. The ink chamber 34 is formed on the vertically upper side of the nozzles 31 in the body 30. The diaphragm 38 is disposed on the vertically upper side of the ink chamber 34, facing the ink chamber 34.

The piezoelectric element 40 works as an actuator that drives the nozzle 31 to discharge the ink. There are piezoelectric elements 40 correspondingly to respective ones of the nozzles 31 of the ink jet head 15. The piezoelectric element 40 includes an element that provokes vibration of the diaphragm 38. The piezoelectric elements 40 are formed in layers on a surface of the diaphragm 38 opposite to the ink chamber 34. The piezoelectric elements 40 thus located each include, for example, a piezo element utilizing the generally known piezoelectric effect that refers to conversion of pressure applied thereto into voltage or applied voltage into pressure.

The piezoelectric element 40 has an upper electrode 41 and a lower electrode 42 stacked in layers. The upper electrodes 41 and the lower electrodes 42 are connected to an electric power unit 45 that supplies power to the piezoelectric elements 40.

The electric power unit 45 is connected to a driver circuit that supplies a drive voltage to the piezoelectric elements 40. The driver circuit is controlled by the controller 20. Thus, the controller 20 further includes a function to serve as a discharge controller that controls the voltage applied to drive the piezoelectric elements 40, or actuators.

Figure 4:
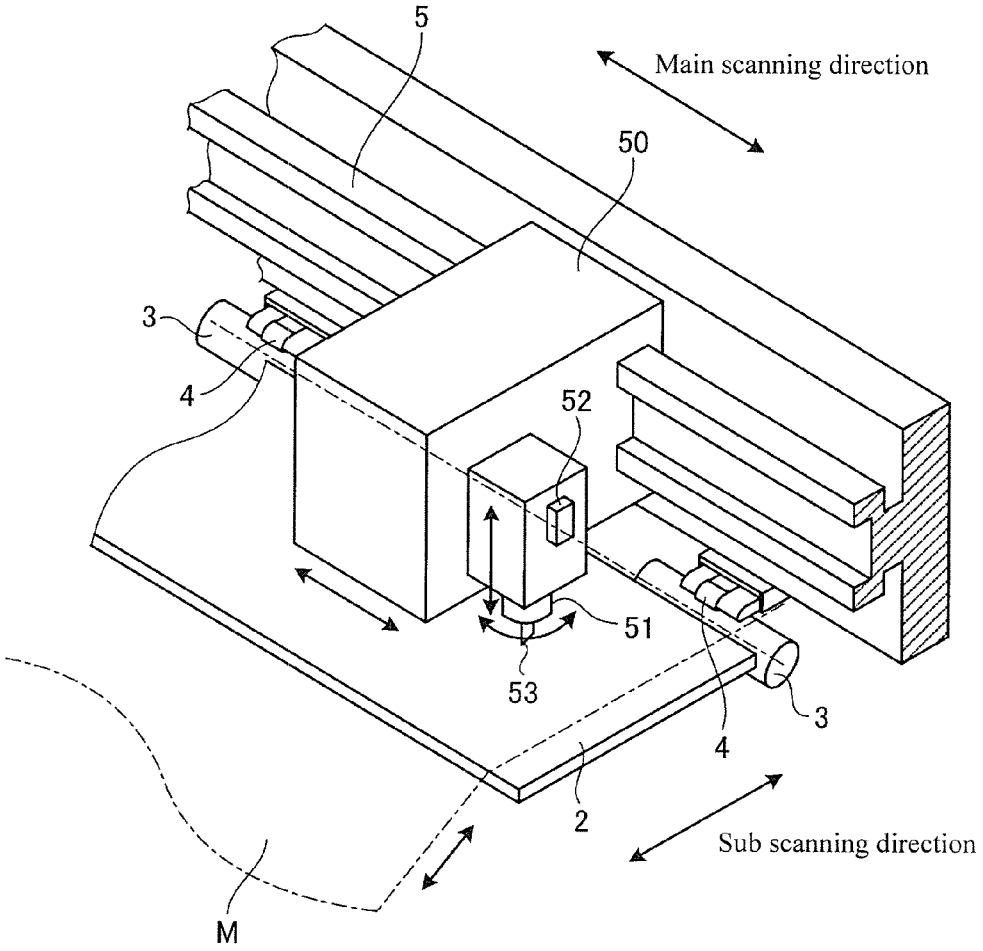
FIG. 4 is a perspective view of a peripheral area of the cutting head illustrated in FIG. 1.
Figure 5:
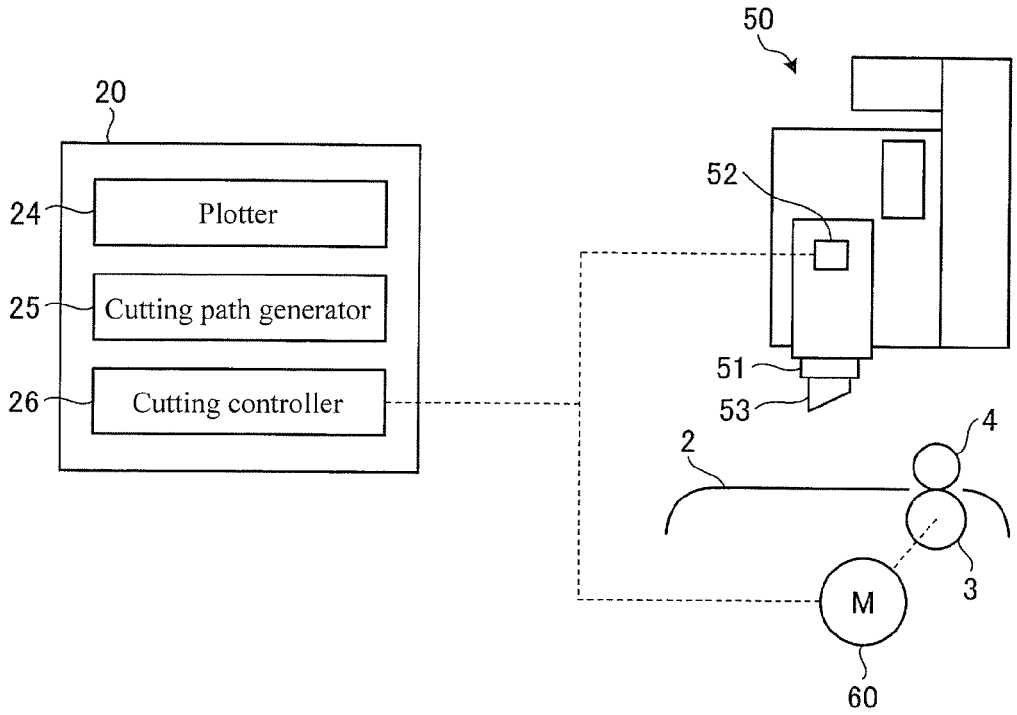
FIG. 5 is a structural view of the cutting head illustrated in FIG. 4.

FIG. 4 is a perspective view of a peripheral area of the cutting head illustrated in FIG. 1. FIG. 5 is a structural view of the cutting head illustrated in FIG. 4. The ink-jet printer 1 has a platen 2 provided as a supporting table for the medium M, and an upper part of the ink-jet printer 1 is exposed on the upper surface of the platen 2. The ink-jet printer 1 further has a plurality of grid rollers 3 for moving the medium M and a plurality of pinch rollers 4 disposed correspondingly to respective ones of the grid rollers 3. The grid rollers 3 are placed at given intervals in the main scanning direction and driven by a conveyor motor 60 installed as a power source that drives feed of the medium M.

The pinch rollers 4 are located on the upper side of the platen 2. The pinch rollers are energized toward the grid rollers 3 under a predetermined pressure and thereby rotatable in concert with the grid rollers 3. With the medium M being interposed between the grid rollers 3 and the pinch rollers 4, the ink-jet printer 1 rotates the grid rollers 3, thereby feeding the medium M in the sub scanning direction.

As with the ink-jet head 15, the cutting head 50 is movable along the guide rail 5 in the main scanning direction. The cutting head 50 has holders 51 to which various cutter blades 53 are attachable. The holder 51 is holding the cutter blade 53 with its blade edge directed toward the medium M. The holders 51 are structured to freely rotate around a rotational axis extending in a direction orthogonal to the medium M. The holders 51 rotate in concert with movements of the cutting head 50 in the main and sub scanning directions relative to the medium M. The holders 51 are accordingly allowed to perform an action generally called "dummy cut" to turn the cutter blades 53 in the cutting direction. This dummy cut refers to cutting of useless parts of the medium M, such as its corner parts, along straight cutting lines in an approximately 5-mm width in order for the cutter blades 53 to be turned in the direction of the cutting lines. According to the embodiment, the cutter blades 53 are changed in direction by the dummy cut.

The holder 51 is capable of keeping an angle of rotation of cutter blade 53 at predetermined angle by an actuator 52, such as solenoid. The rotation of the holder 51 is allowed to be fixed temporarily by the actuator 52 to keep the cutter blade 53 in a posture toward to a predetermined direction in performing the dummy cut. For example, the rotation of the holder 51 is allowed to be fixed by pushing a movable portion of the solenoid against the holder 51.

As with the ink-jet head 15, the cutting head 50 is controllable by the controller 20. The controller 20 has, as its functional elements, a plotter 24 that plots cutting data used to cut the medium M, a cutting path generator 25 that generates cutting paths of the cutting data, and a cutting controller 26 that controls the cutting of the medium M by the cutting head 50 in accordance with the cutting paths. The controller 20, with these functional elements, controls the ink-jet head 15 and the cutting head 50.

The computer 100 is connected to the ink-jet printer 1 with a dedicated cable such as a USB cable or a RS-232C cable, or through network or near field radio communication. The computer 100 may be a resource configured on the Internet.

So far were described the structural features of the ink-jet printer 1 wherein position alignment is performed by the printing position and cutting position adjusting method according to the embodiment. The operation of the ink-jet printer 1 is hereinafter described. When the ink-jet printer 1 prints an image on the medium M, the controller 20, based on image data stored in the computer 100, controls the respective devices of the ink-jet printer 1 to print out the image data. Specifically, under the control by the controller 20, the ink-jet printer 1, while concurrently moving the carriage 10 back and forth in the main scanning direction relative to the medium M, discharges the ink from the ink-jet head 15 within a predetermined print width on the print surface of the medium M. The ink suited for an intended printing is discharged through the nozzles 31 of the ink-jet head 15 to be landed on the medium M.

The ink discharge through the nozzles 31 of the ink-jet head 15 is described in further detail. To discharge the ink through the nozzles 31, the ink stored in the ink tank 6 is guided to the inlet 33 and temporarily stored in the ink chamber 34. After the ink is stored in the ink chamber 34, a voltage is applied to the piezoelectric elements 40 by the electric power unit 45 to drive the piezoelectric elements 40, as controlled by a control signal outputted from the discharge controller 21 of the controller 20.

The discharge controller 21 applies a voltage with a drive waveform to the piezoelectric elements 40. The drive waveform is a preset voltage waveform to drive the piezoelectric elements 40 as desired. The piezoelectric elements 40 are vibrated by the applied voltage. The piezoelectric elements 40 transmit their vibrations to the diaphragm 38, and the diaphragm 38 is vibrated in response to the vibrations transmitted from the piezoelectric elements 40. The ink of the ink chamber 34 runs toward the nozzles 31 in response to the vibration of the diaphragm 38 and is discharged through the discharge ports 32 of the nozzles 31. Thus, the ink jet head 15 performs ink-jet discharge of the ink through the nozzles 31, and the discharged ink is landed on the medium M.

After the ink is landed on the medium M, the ink-jet printer 1, using the exposure controller 22 of the controller 20, controls irradiation of ultraviolet emitted from the ultraviolet lamps 14. First, the ultraviolet lamps 14 irradiate by predetermined timings relatively weak ultraviolet for light exposure of the ink to prevent the ink landed on the medium M from spreading, thereby controlling dot sizes of the ink and preventing smearing of the ink. This step is preliminary curing (pinning exposure). Then, the exposure controller 22 further controls the ultraviolet lamps 14 to irradiate relatively intense ultraviolet on the preliminarily cured ink to fully cure the ink. This step is full curing (curing exposure).

As described, the ink-jet printer 1 discharges the ink and cures the ink landed on the medium M. The ink-jet printer 1 performs the printing in a desired pattern by repeatedly moving the medium M in the feeding direction (sub scanning direction) relative to the carriage 10 within the predetermined print width. During that time, the discharge controller 21 of the controller 20 controls the quantity, timing, and duration of the ink discharge from the ink-jet head 15, and the exposure controller 22 of the controller 20 controls the intensities of ultraviolet irradiated from the ultraviolet lamps 14, and timings and durations of the pinning and curing exposures. The ink-jet printer 1 accordingly prints a desired character or graphic form on the medium M in accordance with a print pattern generated by the control amount setter 23 based on information inputted from the computer 100.

When the medium M is cut by the ink-jet printer 1, the cutting head 50 is operated based on the image data stored in the computer 100 to cut the medium M. The medium M may be cut in entirety in its thickness direction. The medium M, if it is a seal having plural sheets stacked in layers, may be cut in its thickness direction to such a depth that allows only a part of the sheets to be cut.

When the medium M is cut by the ink-jet printer 1, cutting data used to cut the medium M, for example, contour patterns in the image data stored in the computer 100, is plotted by the plotter 24 of the controller 20 based on the image data. After the cutting data is plotted, cutting paths for the cutting to be performed in accordance with the cutting data are generated by the cutting path generator 25, and the cutting head 50 is controlled in accordance with the generated cutting paths. By combining the movements of the cutting head 50 in the main scanning direction and the medium M in the sub scanning direction, the medium M is cut in an optional direction. The cutting head 50 cuts the medium M in accordance with the cutting data, and the ink-jet printer 1 cuts the medium M along the contour or the like of the image data stored in the computer 100.

The ink-jet printer 1 thus prints an image on the medium M and cuts the image-printed medium M. To cut the medium M in accordance with the image printed thereon, position adjustment is necessary between the position of the image printed by the ink-jet head 15 and the position of cutting by the cutting head 50. Printing an image on the medium M and cutting the image-printed medium M are based on the same image data. However, the printing and cutting operations, though based on the same image data, include different processes. This may cause the printed image and the cut image to differ in size. To avoid these events, the ink-jet printer 1 performs alignment between the printing and cutting positions using the printing position and cutting position adjusting method according to the embodiment. Specifically, the ratio of the image actually printed on the medium M to the image data and a ratio in cutting the medium M based on the image data are adjusted to be equal to each other.

Figure 6:
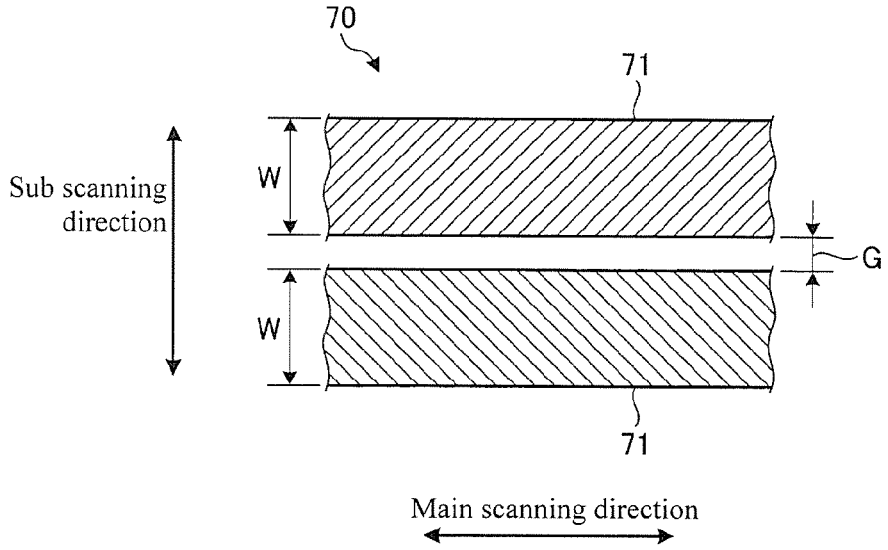
FIG. 6 is an explanatory drawing of a correction value deriving image used in the printing position and cutting position adjusting method according to the embodiment.
Figure 7:
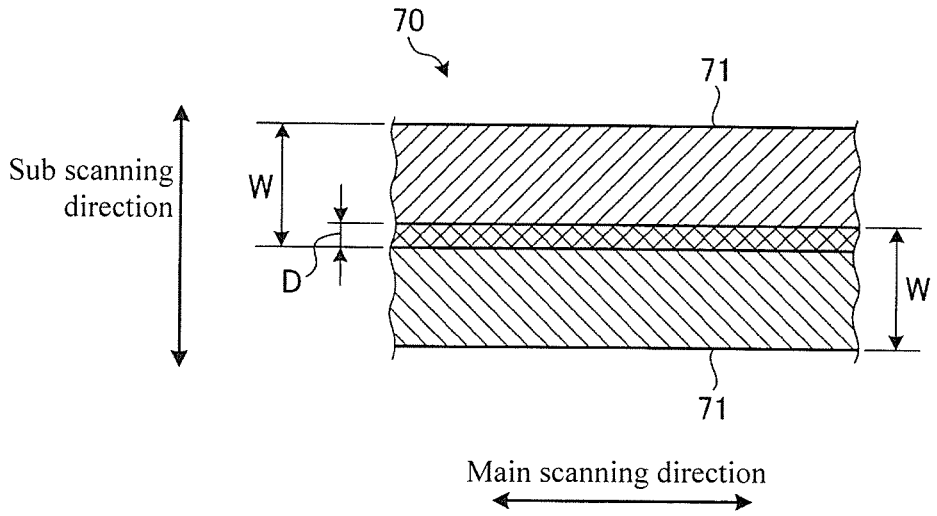
FIG. 7 is an explanatory drawing of a correction value deriving image used in the printing position and cutting position adjusting method according to the embodiment.

FIGS. 6 and 7 are explanatory drawings of a correction value deriving image used in the printing position and cutting position adjusting method according to the embodiment. The ratio of the image printed on the medium M and the ratio in cutting the medium M based on the image data are adjusted to be equal by printing a correction value deriving image 70 on the medium M. When an image is printed on the medium M by the ink-jet printer 1, the correction value deriving image 70 is used to calculate the ratio, in the sub scanning direction, of the image printed on the medium M to the image data. More specifically, the correction value deriving image 70 is an image used to calculate a value of correction for the ink jet head 15 in the sub scanning direction relative to the image data of the image to be printed on the medium M by the ink-jet head 15. In the controller 20 or computer 100 are pre-stored image data adapted for calculation of the value of correction in the sub scanning direction. Based on the image data, the correction value deriving image 70 is printed on the medium M.

The ink-jet printer 1 may have device characteristics more or less different than the other ink-jet printers. Due to the variability of characteristics per device, when the ink-jet printer 1 prints an image on the medium M based on desired image data, streaks extending in the main scanning direction may appear in the sub scanning direction alongside the printed image. To prevent such streaks from appearing on the image, correction settings for image printing based on the image data are inputted, in accordance with the value of correction obtained from the correction value deriving image 70, to the ink-jet printer 1 after the assembling is completed. The correction settings are finished by, for example, inputting the value of correction to the controller 20 by a worker who assembled the ink-jet printer 1.

The correction value deriving image 70 thus used to calculate the value of correction in the sub scanning direction includes a plurality of 1-path images 71 adjacently arranged in the sub scanning direction. Each of the 1-path images is printed by one reciprocation in the main scanning direction of the ink-jet head 15 discharging the ink to print the correction value deriving image 70. To calculate the value of correction in the sub scanning direction, the ratio of the width of a streak-printed part to a width W of a 1-path image 71 in the sub scanning direction is calculated based on the correction value deriving image 70, and the calculated ratio is used as the value of correction.

The specific steps are described below. First, the correction value deriving image 70 including a plurality of 1-path images 71 is printed on the medium M. The printed correction value deriving image 70 is then observed on a magnifying viewing device such as a microscope to calculate a ratio between the width W of a 1-path image 71 in the sub scanning direction and an interval G or an overlapping width D between the 1-path images 71 adjacently arranged in the sub scanning direction.

Similarly to the correction value deriving image 70, the ink-jet printer 1 prints one desired image by printing multiple 1-path images 71, each having the predetermined width W in the sub scanning direction, in a manner that they are adjacently arranged in the sub scanning direction. In any image printed on the medium M without any correction, the 1-path images 71 adjacently arranged in the sub scanning direction may be spaced from each other, or they may partly overlap with each other.

With any interval in the sub scanning direction between the 1-path images 71 adjacently arranged in the sub scanning direction, the interval between the 1-path images 71 may be visually recognized on the image printed on the medium M in the form of a white streak extending in the main scanning direction. With any overlap in the sub scanning direction between the adjacent 1-path images 71 adjacently arranged in the sub scanning direction, the overlapping image parts, naturally with more ink than the other parts, may be visually recognized on the image printed on the medium M in the form of a black streak extending in the main scanning direction.

To prevent such streaks from appearing on the printed image, the correction value deriving image 70 is magnified and observed to calculate, in the correction value deriving image 70, a ratio between the width W of a 1-path image 71 in the sub scanning direction and the interval G or overlapping width D between the 1-path images 71 adjacently arranged in the sub scanning direction. Specifically, the ratio in the distant 1-path images 71 is calculated from the formula $\{(W-G)/W\}$. The ratio in the overlapping 1-path images 71 is calculated from the formula $\{(W+D)/W\}$. Either one of the calculated ratios is inputted as the value of correction to the controller 20 for the correction settings directed to image printing in the sub scanning direction. The ink-jet printer 1, after the correction settings are finished, regulates a rate of feed of the medium M in the sub scanning direction based on the value of correction. Specifically, the ink-jet printer 1 regulates the rate of feed of the medium M in the sub scanning direction relative to one path of the ink-jet head 15. Consequently, streaks resulting from the device variability may be prevented from appearing on the image.

Figure 8:
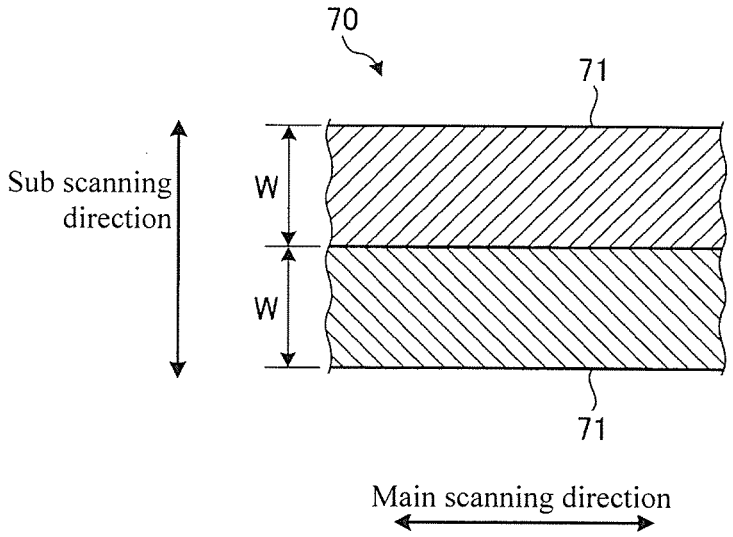
FIG. 8 is an explanatory drawing of a correction value deriving image corrected in the sub scanning direction.

FIG. 8 is an explanatory drawing of the correction value deriving image corrected in the sub scanning direction. On the image printed after the correction settings are finished by inputting the ratio calculated from the correction value deriving image 70 as the value of correction, the 1-path images 71 adjacently printed may be no longer spaced from or overlapping with each other. When, for example, the correction value deriving image 70 is printed on the medium M after the correction settings are finished, the 1-path images 71 adjacently arranged in the sub scanning direction may be printed substantially with neither interval nor overlap between their ends next to each other in the sub scanning direction.

Figure 9:
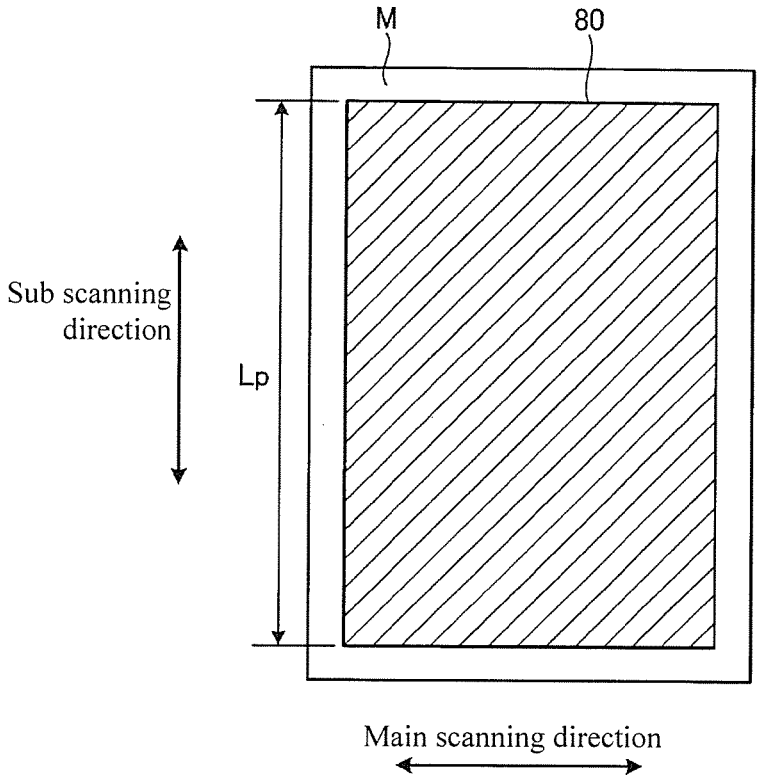
FIG. 9 is an explanatory drawing of a desired image printed on a medium.

FIG. 9 is an explanatory drawing of a desired image printed on a medium. By way of the correcting settings based on the correction value deriving image 70, the adjacent 1-path images 71 may be printed substantially with neither interval nor overlap between their ends. The ink-jet printer 1 may accordingly succeed in printing an image 80 without any streaks appearing on the image 80. The image 80 is printed after the correction is made relative to the image data based on the value of correction calculated from the correction value deriving image 70. The value of correction used then is also used when the ink-jet printer 1 cuts the medium M.

When the image 80 is printed on the medium M by the ink-jet head 15 and the medium M is then cut by the cutting head 50, the cutting head 50, when cutting the medium M based on the image data, cuts the medium M at a cutting position in the sub scanning direction corrected based on calculated the value of correction. When, for example, the medium M is cut by the cutting head 50 along the contour of the image 80 printed on the medium M, cutting data is plotted by the plotter 24 based on the image data of the printed image 80. The cutting head 50 then operates in accordance with the plotted cutting data, thereby cutting the medium M along the contour of the image 80.

The image 80 printed on the medium M has been corrected relative to the image data based on the value of correction calculated from the correction value deriving image 70. The image 80 thus corrected has a length Lp in the sub scanning direction different to a length in the sub scanning direction defined in the image data (not illustrated in the drawings).

When the medium M is cut by the cutting head 50, therefore, the cutting data is connected based on the value of correction obtained from the correction value deriving image 70, and the medium M is cut based on the corrected cutting data. Specifically, the cutting data is subjected to expansion or contraction in the sub scanning direction based on a ratio between the length in the sub scanning direction defined in the image data and the length Lp of the printed image 80 in the sub scanning direction. The cutting head 50, by cutting the medium M in accordance with the cutting data thus corrected, may perform the cutting at the cutting position well-aligned to the position of the image 80 printed on the medium M. The medium M may be accordingly cut with high precision along the contour of the printed image 80.

Figure 10:
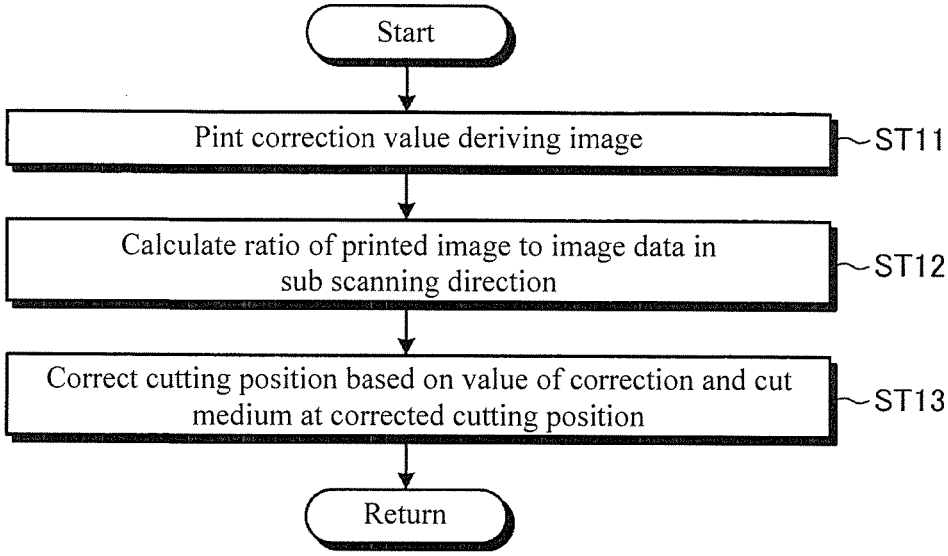
FIG. 10 is a flowchart of position alignment using the printing position and cutting position adjusting method according to the embodiment.

FIG. 10 is a flowchart of position alignment using the printing position and cutting position adjusting method according to the embodiment. The printing position and cutting position adjusting method according to the embodiment performs, in the ink-jet printer 1, steps described below for the printing-cutting position alignment with respect to the medium M. To start with, the method prints the correction value deriving image 70 (Step ST11). To prevent the streaks resulting from the variability of device characteristics from appearing on the image 80, the correction value deriving image 70 pre-stored in the controller 20 or the computer 100 is printed on the medium M by the ink-jet printer 1.

Next, the method calculates, based on the correction value deriving image 70, the ratio, in the sub scanning direction, of the image 80 printed on the medium M to the image data (Step ST12). First, the value of correction that prevents the occurrence of the streaks on the image 80 is calculated based on the correction value deriving image 70. Then, the method calculates the ratio of the length Lp of the printed image 80 in the sub scanning direction to the length defined in the image data in the sub scanning direction.

Then, the cutting position is corrected based on the calculated value of correction, and the medium M is cut at the corrected cutting position (Step ST13). By correcting the cutting data, the positing at which the medium M is cut by the cutting head 50 is aligned to the position of the image 80 printed on the medium M. Then, the medium M is cut at the resulting cutting position. The medium M may be accordingly cut with high precision along the printed image 80.

According to the printing position and cutting position adjusting method of the disclosure, the value of correction for the image 80 to be printed on the medium M relative to the image data is obtained from the correction value deriving image 70. When the medium M is cut based on the image data, the medium M is cut at the cutting position in the sub scanning direction corrected based on the obtained value of correction. This may facilitate alignment of the cutting position to the printing position. The medium M may be cut along the image 80 printed on the medium M at the cutting position well-aligned to the printing position by way of the correction of cutting data alone without the need to detect the size of the printed image 80. This may advantageously facilitate adjustment of the printing and cutting positions.

Further, the method obtains the ratio of the image 80 printed on the medium M to the image data by calculating the ratio between the width W of a 1-path image 71 of the correction value deriving image 70, and the interval G or overlapping width D between the 1-path images 71 adjacently arranged in the sub scanning direction. Therefore, the cutting data may be corrected based on the same value of correction as in the correction of image data to prevent the occurrence of streaks. The cutting position may be more accurately aligned to the printing position. This may advantageously ensure higher accuracy in adjustment of the printing and cutting positions.

Modified Embodiment

The printing position and cutting position adjusting method according to the embodiment calculates only one value of correction based on the correction value deriving image 70. Instead, more than one correction value deriving image may be obtained correspondingly to a printing state on the medium M to allow the cutting head 50 to cut the medium M at the cutting position in the sub scanning direction corrected based on the plural values of correction.

Using a rolled medium as the medium M, for example, a tensile force applied to pull out the medium M may change depending on how much of the rolled medium M is left at that time. This may change the rate of feed of the medium M in the sub scanning direction. Then, the length Lp of the printed image 80 in the sub scanning direction relative to the length in the sub scanning direction defined in the image data may accordingly change with the rate of feed. In the ink jet printer 1 that possibly subject to changes in the rate of feed, the value of correction may be obtained for each of different positions on the medium M.

With the plural values of correction thus obtained, an optional one may be selected from the values of correction and applied to the cutting data every time when the rate of feed of the medium M to be cut changes. Alternatively, the cutting data may be corrected based on an average value of the values of correction and used to cut the medium irrespective of any change in the rate of feed. If the rate of feed of the medium M changes depending on how much of the rolled medium M is left, plural values of correction may be obtained correspondingly to the changing rate of feed to cut the medium M. This may allow for accurate printing-cutting position adjustment.

The ink-jet printer 1 according to the embodiment cures the ink discharged on the medium M by irradiating ultraviolet on the ink. The ink-jet printer 1 may cure the ink by employing a means other than the ultraviolet irradiation. For example, the ink-jet printer 1 may have a heater as a heat source to heat and dry the ink discharged on the medium M. As far as any optional image can be printed on the medium M by discharging the ink thereon, any means may be used to dry the discharged ink.

What is claimed is:

1. A printing position and cutting position adjusting method, comprising:

printing a correction value deriving image on a medium, the correction value deriving image being used to calculate a value of correction of an ink-jet head in a sub scanning direction relative to image data of an image, during the image is printed on the medium by the ink-jet head that discharges an ink on the medium for printing;

calculating a ratio, in the sub scanning direction, of the image printed on the medium to the image data based on the correction value deriving image; and printing the image on the medium using the ink-jet head and cutting the medium using a cutting head based on the image data, wherein the cutting head, before cutting the medium based on the image data, corrects a cutting position in the sub scanning direction based on the value of correction and then cuts the medium.

2. The printing position and cutting position adjusting method according to claim 1, further comprising:

obtaining the ratio, in the sub scanning direction, of the image printed on the medium to the image data by calculating a ratio between a width of a 1-path image printed by one reciprocation in a main scanning direction of the ink-jet head discharging the ink to print the correction value deriving image and an interval or an overlapping width between the 1-path images adjacently arranged in the sub scanning direction.

3. The printing position and cutting position adjusting method according to claim 2, further comprising:

calculating a plurality of the values of correction correspondingly to a printing state on the medium, wherein the cutting head cuts the medium at the cutting position in the sub scanning direction corrected based on the plurality of the values of correction.

4. The printing position and cutting position adjusting method according to claim 1, further comprising:

calculating a plurality of the values of correction correspondingly to a printing state on the medium, wherein the cutting head cuts the medium at the cutting position in the sub scanning direction corrected based on the plurality of the values of correction.

* * * * *